US007304620B2

(12) United States Patent
Yamamoto et al.

(10) Patent No.: US 7,304,620 B2
(45) Date of Patent: Dec. 4, 2007

(54) IMAGE DISPLAY APPARATUS AND IMAGE DISPLAY METHOD

(75) Inventors: Ryoichi Yamamoto, Kanagawa (JP); Seiichi Inoue, Kanagawa (JP); Kenichi Kodama, Kanagawa (JP); Tsutomu Yokouchi, Kanagawa (JP); Kazuo Sanada, Kanagawa (JP); Koichi Kimura, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 657 days.

(21) Appl. No.: 10/934,093

(22) Filed: Sep. 3, 2004

(65) Prior Publication Data

US 2005/0099363 A1 May 12, 2005

(30) Foreign Application Priority Data

Sep. 5, 2003 (JP) ..... 2003-313630

(51) Int. Cl.
*G09G 3/04* (2006.01)

(52) U.S. Cl. ..... 345/5; 345/3.1; 345/41; 345/60; 345/64

(58) Field of Classification Search ..... 345/1.2, 345/3.1, 5, 38, 41, 55, 60, 64
See application file for complete search history.

(56) References Cited

U.S. PATENT DOCUMENTS 3,973,340 A 8/1976 Khawand
4,034,493 A * 7/1977 Ball ..... 40/406
4,610,507 A * 9/1986 Kamamori et al. ..... 349/80
6,037,955 A 3/2000 DeBoer et al.
7,115,297 B2 * 10/2006 Stillman ..... 426/590
2005/0104844 A1 * 5/2005 Nakai et al. ..... 345/107

FOREIGN PATENT DOCUMENTS

| | | |
|---|---|---|
| EP | 05241515 | 9/1993 |
| GB | 23849 | 8/1913 |
| JP | 05-127603 | 5/1993 |
| JP | 05-127604 | 5/1993 |
| JP | 2001-042794 | 2/2001 |
| JP | 2002-169105 | 6/2002 |

* cited by examiner

*Primary Examiner*—Bipin Shalwala
*Assistant Examiner*—Vincent E. Kovalick
(74) *Attorney, Agent, or Firm*—Whitham Curtis Christofferson & Cook, PC

(57) ABSTRACT

The method and apparatus for displaying an image using liquid generate a segment fluid row, in which plural liquid masses each of which includes first liquid having at least one predetermined coloring matter and are separated from each other are arranged in a row shape, by sequentially and intermittently supplying predetermined amounts of the first liquid in accordance with image information of a desired image to be displayed to a flow path provided in accordance with an image display region for image displaying; and display the desired image in the image display region with the first liquid by causing the generated segment fluid row to move to a predetermined position of said flow path.

12 Claims, 12 Drawing Sheets

IMAGE DISPLAY APPARATUS AND IMAGE DISPLAY METHOD

BACKGROUND OF THE INVENTION

The present invention relates to an image display apparatus, in particular, a thin image display apparatus such as a flat panel display and an image display method therefor.

Conventionally, a liquid crystal display apparatus (LCD) has been widely used as an image display apparatus of an information terminal device, such as a personal computer or a personal digital assistant (PDA), or a car navigation system. The liquid crystal display apparatus has advantages such as a high response speed and an ability to display clear color moving images, although it also has disadvantages such as a complicated structure and a high production cost resulting in a high product price, a high power consumption, necessity of supplying electric power for image holding, a narrow viewing angle, and the like. Therefore, image display apparatuses adopting various systems are proposed as alternatives to the liquid crystal display apparatus.

For instance, a display apparatus is proposed, which performs switching between ON and OFF of an image by utilizing a liquid film boiling phenomenon (see JP 05-127603 A and JP 05-127604 A, for instance). Also, a display apparatus is proposed which loads/unloads ink in a cell into/from an image display portion through thermal expansion/shrinkage of the ink or mechanical driving or a diaphragm, thereby performing switching between ON and OFF of an image (see JP 2001-42794 A, for instance). Further, a display apparatus is proposed which adopts a system where approximately one-half of lightproof fluid is sealed in a translucent enclosure (cell) partially covered with a light shielding mask and switching between light transmission and light shielding is performed by driving the lightproof fluid using a gradient of the surface tension of the lightproof fluid caused through irradiation of infrared rays from outside (see JP 2002-169105 A, for instance).

In the case of the image display apparatus disclosed in JP 05-127603 A and JP 05-127604 A described above which utilizes the fluid film boiling phenomenon, however, the duration of the film boiling is as short as 10 μsec, so there is a problem in that in order to continue to display an image, it is required to continue to apply a voltage of around 10 kHz. Aside from this, there are various problems in that the durability of the apparatus is low and the chromas of displayed images are low and the like.

Also, in the case of the system disclosed in JP 2001-42794 A described above which utilizes thermal expansion and shrinkage of the ink, the thermal expansion coefficient of the ink is low, so even if the ink is heated to a temperature of from 300 K to 350 K, the volume change of the ink is as small as about 2%. Therefore, in order to ensure a predetermined volume increase, a reservoir tank that is considerably large with respect to the volume of the image display portion is required, which leads to a problem in that the size of the apparatus becomes larger. Also, in the case of the system based on the diaphragm mechanical driving, there is a problem in that the structure of the apparatus becomes complicated, which inhibits miniaturization of the apparatus. Further, in the case of the system disclosed in JP 2002-169105 A described above, light with a specific wavelength is blocked by the light shielding mask, so there occurs a problem in that once information is written by causing the lightproof fluid to move, it is impossible to refresh the written information.

SUMMARY OF THE INVENTION

The present invention has been made in order to solve the problems described above and has an object to provide an image display apparatus and an image display method, with which it becomes possible to hold written information without supply of energy from outside, to form an image that is high in durability and chroma, to realize a simple structure, and to achieve miniaturization.

In order to attain the object described above, the present invention provides an image display apparatus that displays an image using liquid, comprising an image display plate having an image display region, a flow path provided in accordance with the image display region and regulating a moving direction of the fluid and a segment fluid row formation means for generating a segment fluid row, in which plural liquid masses each or which includes first liquid having at least one predetermined coloring matter and are separated from each other are arranged in a row shape, by sequentially and intermittently supplying predetermined amounts of the first liquid to the flow path in accordance with image information of a desired image to be displayed, and causing the generated segment fluid row to move in the flow path, wherein the desired image is displayed in the image display region by the first liquid of the segment fluid row moved to a predetermined position of the flow path.

Preferably, the plural liquid masses of the segment fluid row are separated from each other by gas or liquid.

Preferably, the segment fluid row formation means generates the segment fluid row by arranging plural liquid masses made of second liquid having transparency in a row shape through division of the second liquid in advance and injecting the first liquid into the plural liquid masses of the second liquid in accordance with the image information.

Preferably, the segment fluid row formation means generates the segment fluid row by arranging the plural liquid masses made of the first liquid in a row manner through division of the first liquid in advance and injecting second liquid into the plural liquid masses of the first liquid in accordance with the image information.

An example of the first liquid included in each liquid mass may be one of liquid colored using at least one of three coloring matters for R (red), G (green), and B (blue) and liquid colored using at least one of four coloring matters for C (cyan), M (magenta), Y (yellow), and K (black).

Preferably, the flow path includes a position adjustment means for, when the movement of the segment fluid row by the segment fluid row formation means is stopped, adjusting a position of each liquid mass of the segment fluid row.

An example of the position adjustment means may be one of water-repellent treatment portions and water-receptive treatment portions formed for a wall surface of the flow path and holding each liquid mass of the segment fluid row.

Another example of the position adjustment means may be depression portions formed for a wall surface of the flow path and holding each liquid mass of the segment fluid row.

As an example, the flow path may have one flow path entrance and one flow path exit and one segment fluid row moving path may be formed between the flow path entrance and the flow path exit.

As another example, the flow path may have at least two flow path entrances and at least two flow path exits, with the flow path entrances and the flow path exits being in a one-to-one correspondence, and at least two segment fluid row moving paths may be formed between the flow path entrances and the flow path exits.

Preferably, the segment fluid row moving paths extend parallel to each other.

In order to attain the object described above, the present invention also provides an image display method for displaying an image using liquid, comprising generating a segment fluid row, in which plural liquid masses each of which includes first liquid having at least one predetermined coloring matter and are separated from each other are arranged in a row shape, by sequentially and intermittently supplying predetermined amounts of the first liquid in accordance with image information of a desired image to be displayed to a flow path provided in accordance with an image display region for image displaying, and displaying the desired image in the image display region with the first liquid by causing the generated segment fluid row to move to a predetermined position of the flow path.

According to the present invention, there are obtained an image display apparatus and an image display method, with which it becomes possible to hold written information without supply of energy from outside, to form an image that is high in durability and chroma, to realize a simple structure, and to achieve miniaturization.

This application claims priority on Japanese patent application No. 2003-313630, the entire contents of which are hereby incorporated by reference.

DETAILED DESCRIPTION OF THE PREFERRED EMBODIMENTS

First Embodiment

Figure 1:
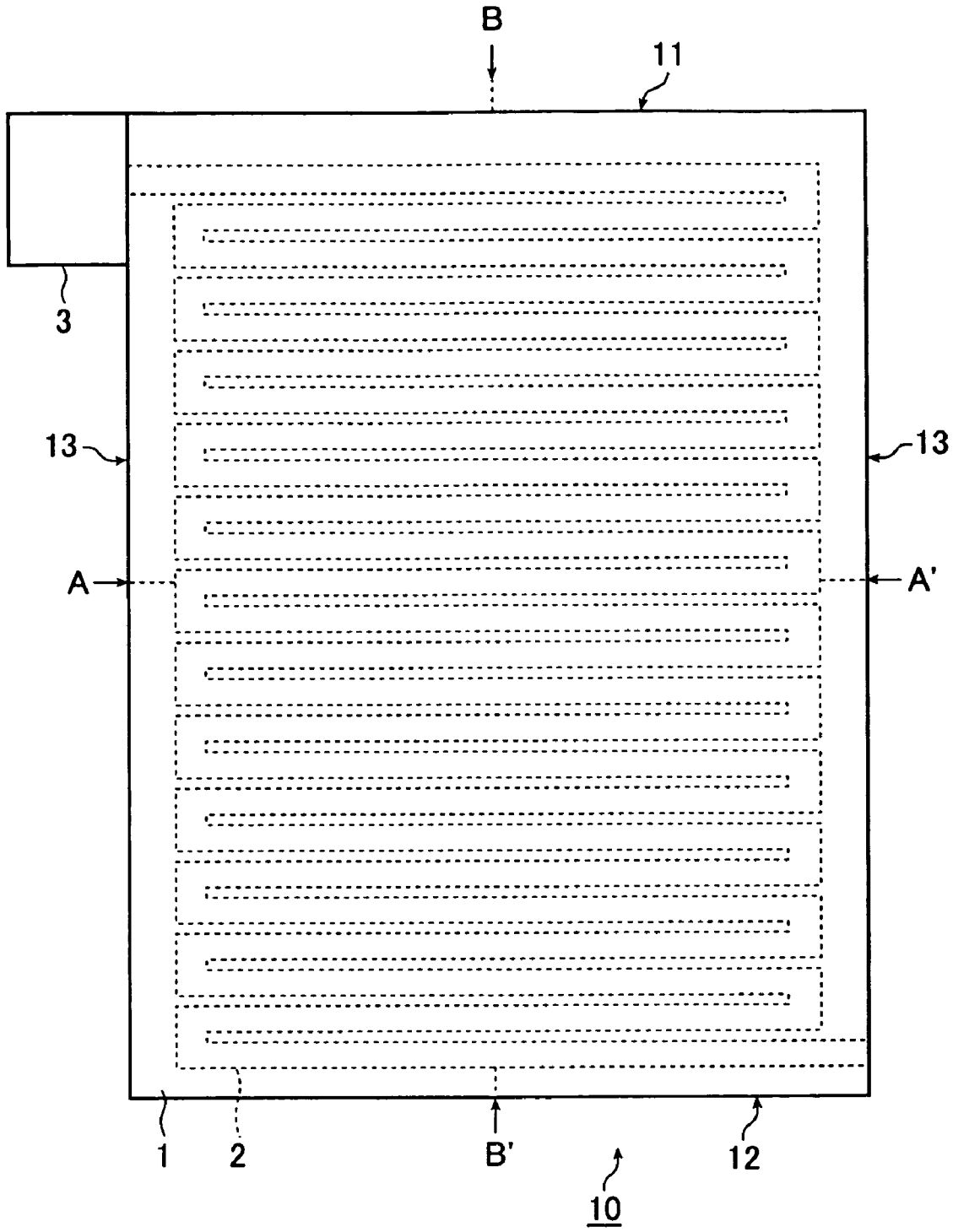
FIG. 1 is a plan view of an image display apparatus according to a first embodiment of the present invention.
Figure 2A:
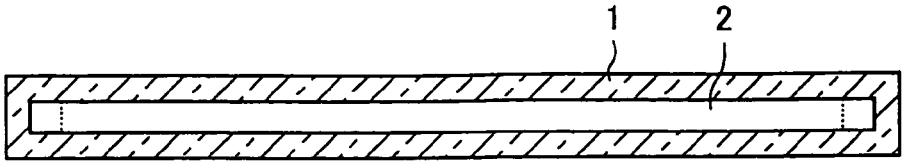
FIGS. 2A and 2B each are a vertical cross-sectional view of the image display apparatus according to the first embodiment of the present invention.

An image display apparatus according to a first embodiment of the present invention will be described. FIG. 1 is a plan view of an image display apparatus 10 according to this embodiment. Also, FIG. 2A is a vertical cross-sectional view showing a cross section where the image display apparatus 10 is cut along a plane extending along the line A-A' in FIG. 1 and perpendicular to the paper plane of FIG. 1. Hereinafter, in this specification, the term "vertical cross-sectional view" means a cross-sectional views taken along a plane extending orthogonal to a paper plane or to an image display plate 1 to be described later. Further, FIG. 2B is a vertical cross-sectional view where the image display apparatus 10 is cut along a plane extending along the line B-B' in FIG. 1.

As shown in FIG. 1, the image display apparatus 10 includes a flat-plate-shaped image display plate 1 and a segment fluid row formation unit (segment fluid row formation means) 3 arranged adjacent to the image display plate 1. It is sufficient that the image display plate 1 is made of a transparent material, meaning that the material of the image display plate 1 is not specifically limited. For instance, it is possible to use glass, acrylic, a transparent resin, such as vinyl chloride, or the like as the material of the image display plate 1.

The segment fluid row formation unit 3 forms a segment fluid row where liquid masses that have predetermined coloring matters and are separated from each other by fluid are arranged in a row shape. Hereinafter, the liquid masses will be referred to as the "liquid D" (see FIG. 13) and the fluid separating the liquid D will be referred to as the "separation fluid V" (see FIG. 13).

Figure 2B:
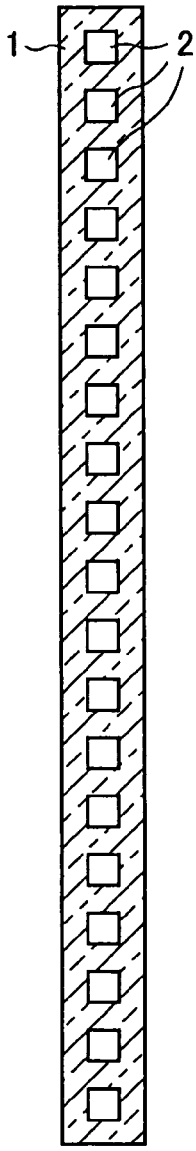

As shown in FIGS. 1, 2A, and 2B, a hollow flow path 2 is formed in the image display plate 1. Also, multiple pixel equivalent portions are arranged in a matrix shape on the upper surface of the image display plate 1, thereby forming an image display region. The flow path 2 is formed below the pixel equivalent portions in the image display region in a zigzag shape where the flow path 2 traces every pixel equivalent portion with so-called "one stroke". Aside from this, the flow path 2 may also be formed in a spiral shape, for instance.

The flow path 2 according to this embodiment is formed by a single tubular hole formed in a zigzag shape in the image display plate 1. That is, as shown in FIG. 1, the flow path 2 is formed by repeating a pattern where the flow path extends from one end to the other end in a widthwise direction of the image display plate 1, is bent by 180° at the other end, and extends back to the one end. With this construction, the flow path 2 functions as a moving path, where the first liquid flows, that regulates the moving direction of fluid.

It should be noted that in FIGS. 2A and 2B, the flow path 2 in the image display apparatus 10 according to this embodiment has a rectangular cross section, although the cross-sectional shape is not limited to this. That is, the flow path 2 may be formed so as to have a non-rectangular cross section, such as a circular cross section, an oval cross section, or a closed-curve cross section. Also, as shown in FIG. 1, in the image display apparatus 10 according to this embodiment, the flow path 2 is formed in a shape that is bent at right angles in the vicinity of the right and left end portions of the image display plate 1, although the present invention is not limited to this. For instance, a part of the flow path 2 may be formed in a shape where each portion connecting the end portions of two adjacent straight-line portions is formed in a curved shape so as to have a horizontal cross section (cross section cut along a plane extending parallel to the upper surface of the display plate) drawing a circular arc.

The shape and area of the cross section of the flow path 2 are not specifically limited irrespective of the surface tensions of the separation fluid and the first liquid to be described later so long as smooth flow is possible. For instance, the size (width, height, or diameter) of the cross section of the flow path 2 may be set at 0.2 to 5 mm×0.2 to 5 mm and the cross-sectional area of the flow path 2 may be set at 0.04×25 $mm^2$. Also, as will be described later, multiple flow paths 2 may be formed in the single image display plate 1. For instance, multiple flow paths 2 may be formed parallel to each other and parallel to a vertex portion 11 or side portions 13 of the image display plate 1. In this case, only one segment fluid row formation unit 3 may be provided and may supply the first liquid and the separation fluid to every flow path 2, otherwise one segment fluid row formation unit 3 may be disposed for each of the multiple flow paths 2. Further, the flow path 2 may be a tube made of a transparent material.

Figure 3A:
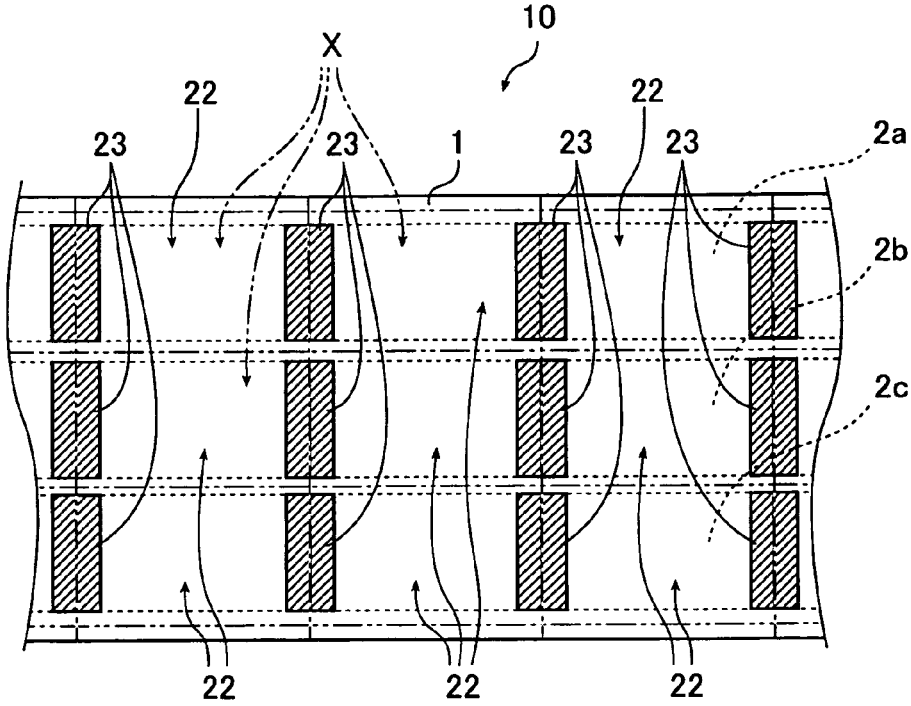
FIGS. 3A and 3B each are a partial enlarged plan view and a partial enlarged cross-sectional view of the image display apparatus according to the first embodiment of the present invention.
Figure 3B:
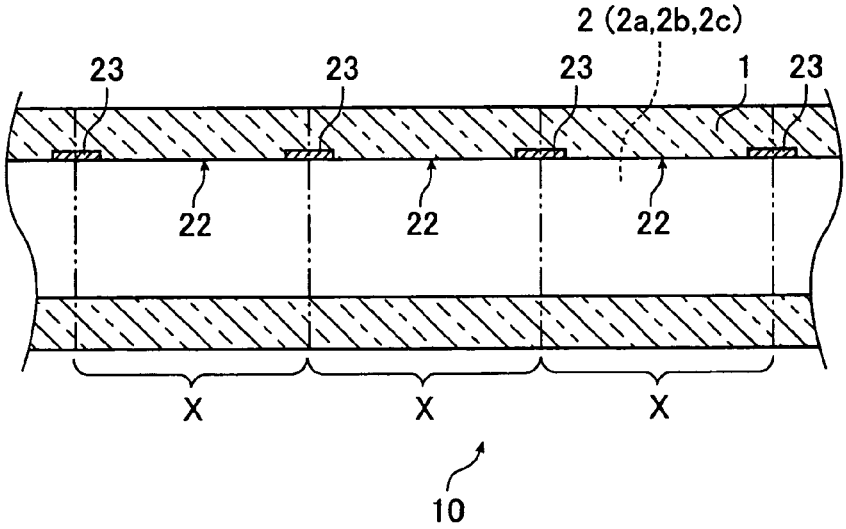

Next, position adjustment portions formed on the wall surface of the flow path 2 serving as a position adjustment means will be described. FIG. 3A is a partially enlarged plan view of the image display plate 1 and FIG. 3B is a partially enlarged cross-sectional view of the image display plate 1. In FIGS. 3A and 3B, the two-dot chain lines indicate boundaries between pixel equivalent portions X, each of which corresponds to one pixel. As shown in FIG. 3A, in the image display plate 1, ink-repellent treatment portions 23 are provided in the upper portion of the flow path wall surface of the flow path 2 (2*a*, 2*b*, 2*c*) and the pixel equivalent portions X ($X_1$, $X_2$, $X_3$, . . . , $X_n$), each of which corresponds to one pixel are obtained through division by the ink-repellent treatment portions 23.

Here, each "ink-repellent treatment portion" refers to a portion an which ink-repellent treatment is implemented and the property is given for repelling liquid D to be described later. For instance, when water-based ink is used as the first liquid constituting the liquid D, water-repellent treatment corresponds to the "ink-repellent treatment". On the other hand, when oil-based ink is used, water-receptive treatment corresponds to the "ink-repellent treatment". As a method for forming water-repellent treatment portions that are one kind of the ink-repellent treatment portions, it is possible to use a method with which a fluorine-based material, such as fluororesin, is patterned through lithography processing following the application of the fluorine-based material, a method with which a silicon-based material is applied, a method with which surface roughness is changed, or the like.

In the image display apparatus 10, the ink-repellent treatment portions 23 are formed on the periphery of the boundary portions between the pixel equivalent portions in the flow path 2, so that the upper portion of the wall surface of the flow path 2 between two adjacent ink-repellent treatment portions 23 becomes the position adjustment portions 22 having a relative affinity for the ink constituting the liquid D. Therefore, even when the liquid D that should be held at the position of a position adjustment portion 22 halts at a position between two adjacent position adjustment portions 22, where the ink-repellent treatment portion 23 is formed, so the liquid D is caused to move to the position of the position adjustment portion 22 having a higher affinity. That is, a "self-alignment effect" is obtained which is an effect that it is possible to adjust the position of the liquid D supplied into the flow path 2 by means of the property of the flow path 2 itself. Note that the ink-repellent treatment portions 23 may be formed only in a part of the image display plate 1.

Next, the segment fluid row formation unit 3 according to this embodiment will be described. As shown in FIG. 1, the segment fluid row formation unit (segment fluid row formation means) 3 is disposed in the left-side upper portion of the image display apparatus 10 in FIG. 1. This segment fluid row formation unit 3 generates a segment fluid row by alternately supplying the liquid D and the separation fluid V into the flow path 2 and causes the generated segment fluid row to move in the flow path 2, thereby displaying an image on the image display plate 1.

Figure 4:
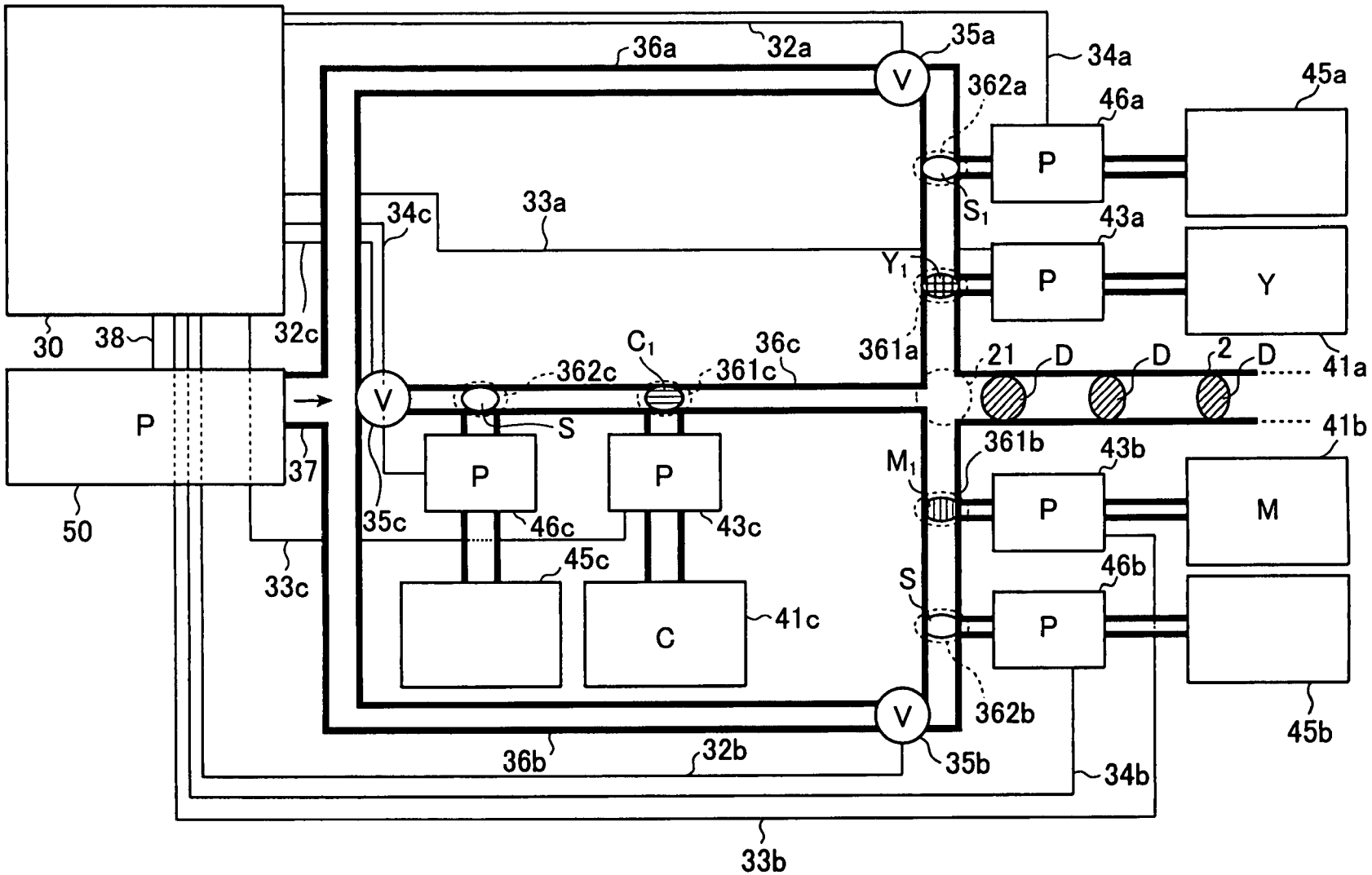
FIG. 4 is a schematic diagram showing an internal construction of a segment fluid row formation unit according to the first embodiment of the present invention.

FIG. 4 a schematic diagram showing an internal construction or the segment fluid row formation unit 3 according to this embodiment. As shown in FIG. 4, disposed in the segment fluid row formation unit 3 are vessels 41*a*, 41*b*, and 41*c* each of which contains the first liquid, pumps 43*a*, 43*b*, and 43C each of which respectively supplies the first liquid contained in the vessels 41*a*, 41*b*, and 41*c*, vessels 45*a*, 45*b*, and 45*c* each of which contains second liquid, pumps 46*a*, 46*b*, and 46*c* each of which respectively supplies the second liquid contained in the vessels 45*a*, 45*b*, and 45*c*, a pump 50 that supplies the separation fluid V, and a control portion 30. For instance, the pumps 43*a*, 43*b*, 43*c*, 46*a*, 46*b*, and 46*c* may be diaphragm pumps. In this case, actuators that drive diaphragm portions of the diaphragm pumps may be electrostatic force actuators, piezo actuators, thermal bimorph actuators, thermal-pressure effect (thermo-pneumatic) actuators, or the like.

Here, the "first liquid" contained in each vessel 41*a*, 41*b*, or 41*c* is ink having a coloring matter and is not specifically limited so long as it is liquid that is capable of moving in the flow path 2 and displaying a specific color in the flow path 2. For instance, the first liquid in each vessel 41*a*, 41*b*, or 41*c* may be liquid where a pigment or a dye is mixed with colorless and transparent liquid, such as ink having a coloring matter for one of R (red), G (green), and B (blue) or for one of Y (yellow), M (magenta), C (cyan), and K (black) and exhibiting a specific color or liquid where such ink is diluted with a diluent. In this embodiment, Y (yellow) ink, M (magenta) ink, and C (cyan) ink are used as the first liquid, with the Y (yellow) ink contained in the vessel 41*a*, the M (magenta) ink contained in the vessel 41*b*, and the C (cyan) ink contained in the vessel 41*c*.

Also, the "second liquid" refers to liquid having compatibility with the first liquid described above. The second liquid is mixed with the first liquid and constitutes the liquid D having a desired optical density (hereinafter simply referred to as the "density"). When it is possible to obtain the liquid D exhibiting a color having a desired density only with the first liquid, the second liquid may be omitted. The second liquid is not specifically limited so long as it is colorless and transparent liquid having compatibility with the first liquid. For instance, it is possible to use water, each kind of hydrocarbon, silicon oil, or the like as the second liquid. In this embodiment, carrier liquid S is used as the second liquid and is contained in the vessels 45*a*, 45*b*, and 45*c*.

Further, the "separation fluid V" is fluid that is inserted between two of liquid D existing adjacent to each other through the separation fluid V in front and back of the moving direction of fluid in the flow path 2, and maintains a constant distance therebetween. The separation fluid V is not specifically limited so long as it is fluid that has no compatibility with the liquid D and provides such a constant distance maintaining effect. Also, the separation fluid V may be gas or liquid. As the separation fluid V that is liquid, water, each kind of hydrocarbon, silicon oil, and the like may be used for example. Also, as the separation fluid V that is gas, air, nitrogen gas, an inert gas, and the like may be used for example. In this embodiment, air is used as the separation fluid V.

In the segment fluid row formation unit 3 according to this embodiment, the pump 50 and the flow path 2 are connected to each other through a pipe 37 and three pipes 36*a*, 36*b*, and 36*c* that branch in three directions from the pipe 37. The pipes 36*a*, 36*b*, and 36*c* merge with each other at a merge point 21 provided in an end portion of the flow path 2 on an upstream side in the fluid moving direction (at the upper left corner in FIG. 1).

The pipe 36*a* is connected to the vessel 45*a* and the pump 46*a* through a connection portion 362*a* and, when the pump 46*a* is actuated, the carrier liquid S contained in the vessel 45*a* is supplied to the connection portion 362*a* of the pipe 36*a*. Similarly, the pipe 36*a* is connected to the vessel 41*a* and the pump 43*a* through a connection portion 361*a* and, when the pump 43*a* is actuated, the Y (yellow) ink contained in the vessel 41*a* is supplied to the connection portion 361*a* of the pipe 36*a*. In addition, the pipe 36*a* is provided with a valve 35*a* and supply of the separation fluid V to the pipe 36*a* is controlled through opening/closing of the valve 35*a*.

The pipe 36*b* is connected to the vessel 45*b* and the pump 46*b* through a connection portion 362*b* and, when the pump 46*b* is actuated, the carrier liquid S contained in the vessel 45*b* is supplied to the connection portion 362*b* of the pipe 36*b*. Similarly, the pipe 36*b* is connected to the vessel 41*b* and the pump 43*b* through a connection portion 361*b* and, when the pump 43*b* is actuated, the M (magenta) ink contained in the vessel 41*b* is supplied to the connection portion 361*b* of the pipe 36*b*. In addition, the pipe 36*b* is provided with a valve 35*b* and supply of the separation fluid V to the pipe 36*b* is controlled through opening/closing of the valve 35*b*.

The pipe 36*c* is connected to the vessel 45*c* and the pump 46*c* through a connection portion 362*c* and, when the pump 46*c* is actuated, the carrier liquid S contained in the vessel 45*c* is supplied to the connection portion 362*c* of the pipe 36*c*. Similarly, the pipe 36*c* is connected to the vessel 41*c* and the pump 43*c* through a connection portion 361*c* and, when the pump 43*c* is actuated, the C (cyan) ink contained in the vessel 41*c* is supplied to the connection portion 361*c* of the pipe 36*c*. In addition, the pipe 36*c* is provided with a valve 35*c* and supply of the separation fluid V to the pipe 36*c* is controlled through opening/closing of the valve 35*c*.

The pump 43*a* and the control portion 30 are connected to each other through wiring 33*a*, the pump 46*a* and the control portion 30 are connected to each other through wiring 34*a*, and the valve 35*a* and the control portion 30 are connected to each other through wiring 32*a*. Also, the pump 43*b* and the control portion 30 are connected to each other through wiring 33*b*, the pump 46*b* and the control portion 30 are connected to each other through wiring 34*b*, and the valve 35*b* and the control portion 30 are connected to each other through wiring 32*b*. Further, the pump 43*c* and the control portion 30 are connected to each other through wiring 33*c*, the pump 46*c* and the control portion 30 are connected to each other through wiring 34*c*, and the valve 35*c* and the control portion 30 are connected to each other through wiring 32*c*.

With this construction, start and stop of supply of the carrier liquid S, the Y (yellow) ink, and the separation fluid V into the pipe 36*a* are controlled through actuation of the pumps 43*a* and 46*a* and the valve 35*a* under control by the control portion 30. Similarly, start and stop of supply of the carrier liquid S, the M (magenta) ink, and the separation fluid V into the pipe 36*b* are controlled through actuation of the pumps 43*b* and 46*b* and the valve 35*b* under control by the control portion 30. Similarly, start and stop of supply of the carrier liquid S, the C (cyan) ink, and the separation fluid V into the pipe 36*c* are controlled through actuation of the pumps 43*c* and 46*c* and the valve 35*c* under control by the control portion 30. Consequently, switching between start and stop of supply of the liquid D is performed through control of the actuation of the pumps 43*a* to 43*c* and the pumps 46*a* to 46*c* and the opening/closing of the valves 35*a* to 35*c*.

Next, a procedure for forming liquid D having a specific color in the image display apparatus of this embodiment will be described. In order to supply liquid D containing multiple kinds of ink and the carrier liquid S, multiple kinds of the first liquid composing liquid D are formed in the pipes 36 (36*a*, 36*b*, 36*c*) and are merged at the merge point 21 and mixed with each other, thereby forming liquid D exhibiting a desired color. For instance, in order to form liquid D containing the Y (yellow) ink, the M (magenta) ink, the C (cyan) ink, and the carrier liquid S, the pump 46*a* is actuated and a predetermined amount of carrier liquid $S_1$ is supplied to the connection portion 362*a* of the pipe 36*a*. Then, the pump 46*a* is stopped and the valve 35*a* is opened for an extremely short period of time, thereby sending the carrier liquid $S_1$ to the connection portion 361*a*.

Next, the pump 43*a* is actuated and a predetermined amount of Y (yellow) ink is injected into the carrier liquid $S_1$. In this manner, first liquid $Y_1$ in Y (yellow) having a predetermined color density is formed at the position of the connection portion 361*a*. In synchronization with the operations of the pumps 46*a* and 43*a* and the valve 35*a* for Y (yellow), the pumps 46*b* and 43*b* and the value 35*b* for M (magenta) and the pumps 46*c* and 43*c* and the valve 35*c* for C (cyan) are actuated in a like manner, thereby forming first liquid $M_1$ in M (magenta) having a predetermined color density at the position of the connection portion 361*b* and forming first liquid $C_1$ in C (cyan) having a predetermined color density at the position of the connection portion 361*c*.

Next, the valves 35*a* to 35*c* are opened and a predetermined amount of separation fluid V is supplied to the pipes 36*a* to 36*c*. As a result, the first liquid $Y_1$, the first liquid $M_1$, and the first liquid $C_1$ move in the pipes 36*a* to 36*c*, respectively, by means of the pressure of the separation fluid V and are merged at the merge point 21 and unified with each other. Through this unification, the first liquid $Y_1$, the first liquid $M_1$, and the first liquid $C_1$ are mixed with each other and liquid D having a predetermined color and a predetermined density is formed. Then, this liquid D is moved and supplied to the flow path 2 by means of the pressure of the separation fluid V. Note that when the carrier liquid S is not used as the liquid D, the ink may be directly supplied to the connection portions 361*a* to 361*c* of the pipes 36*a* to 36*c* and sent to the merge point 21 by means of the pressure of the separation fluid V. Also, in accordance with the color to be displayed with the liquid D, the amount of the carrier liquid S supplied to the connection portions 362*a* to 362*c* and the amount and kind of the ink injected into the carrier liquid S are adjusted as appropriate.

Further, in the example described above, a case has been described in which the pumps 46 (46*a*, 46*b*, 46*c*) and the vessels 45 (45*a*, 45*b*, 45*c*) for supplying the carrier liquid S are provided on an upstream side in the fluid moving direction of the pipes 36 (36*a*, 36*b*, 36*c*), while the pumps 43 (43*a*, 43*b*, 43*c*) and the vessels 41 (41*a*, 41*b*, 41*c*) for supplying the ink are provided on a downstream side in the fluid moving direction, and the ink is injected into the carrier liquid S supplied to the pipes 36 (36*a*, 36*b*, 36*c*). However, the present invention is not limited to this and another construction may be adopted in which, for instance, the pumps 43 (43*a*, 43*b*, 43*c*) and the vessels 41 (41*a*, 41*b*, 41*c*) for supplying the ink are provided on the upstream side in the fluid moving direction of the pipes 36 (36*a*, 36*b*, 36*c*), while the pumps 46 (46*a*, 46*b*, 46*c*) and the vessels 45 (45*a*, 45*b*, 45*c*) for supplying the carrier liquid S are provided on the downstream side in the fluid moving direction, and the carrier liquid S is injected into the ink supplied to the pipes 36 (36*a*, 36*b*, 36*c*).

Figure 5:
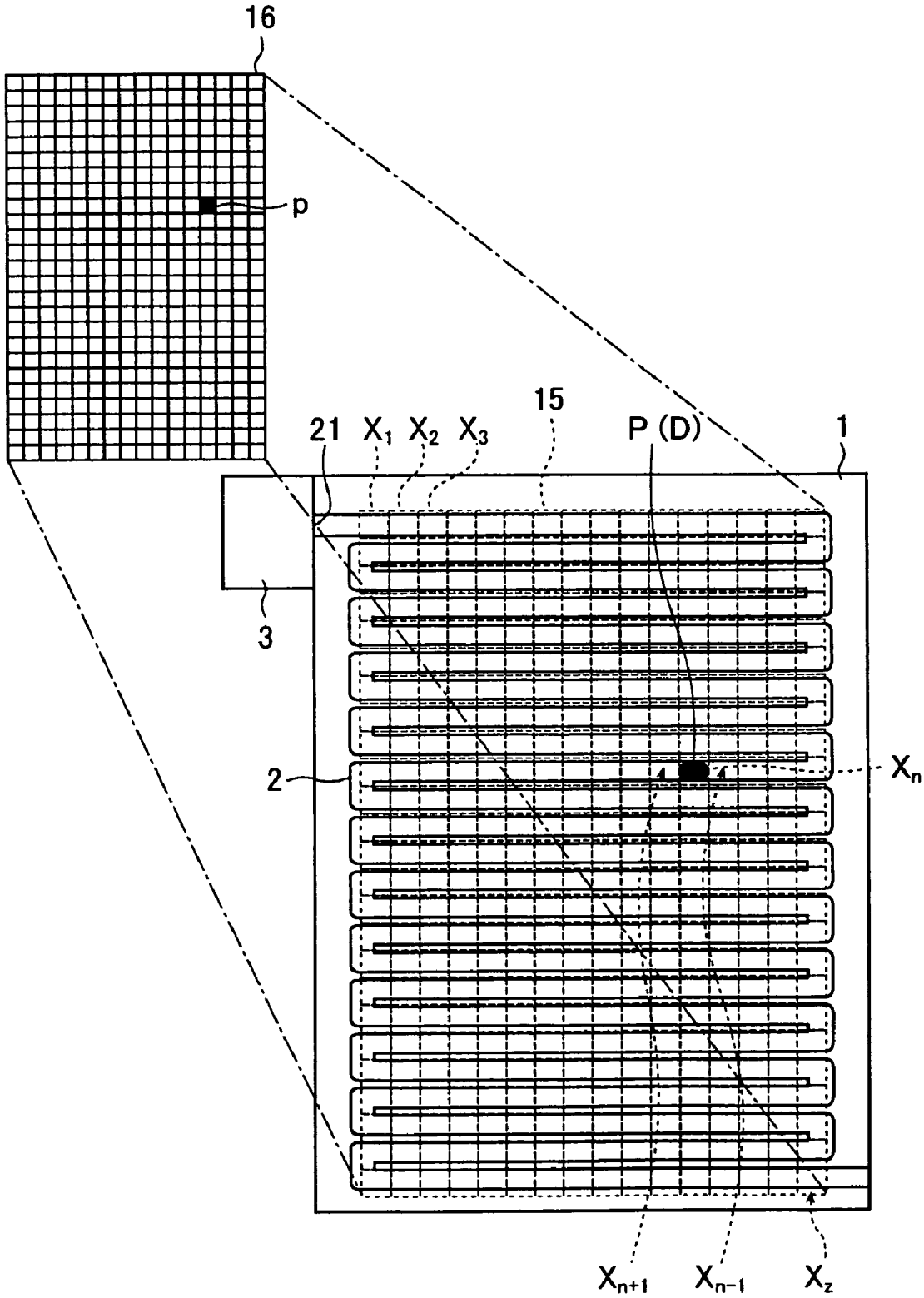
FIG. 5 shows a relation between an input screen and an image display plate according to the first embodiment of the present invention.

Next, a relation between the image display plate 1 and image information will be described. In order to display an image using the image display apparatus 10 according to this embodiment, an input apparatus such as a scanner is connected to the image display apparatus 10 and image information is inputted from the input apparatus into the image display apparatus 10. FIG. 5 shows a relation between an input screen 16 and the image display plate 1 in the case where the image display apparatus 10 according to this embodiment is connected to an input apparatus provided with the input screen 16. As shown in FIG. 5, an image display region 15 is formed on the upper surface of the image display plate 1. Also, the position adjustment portions are provided in the flow path 2 so that when supply of the liquid D and the separation fluid V is stopped, the liquid D is adjusted so as to be positioned at predetermined positions, and multiple pixel equivalent portions $X_1$, $X_2$, $X_3$, . . . are formed in the image display region 15 in a matrix shape in accordance with the positions of the position adjustment portions. Each of the pixel equivalent portions $X_1$, $X_2$, $X_3$, . . . becomes a pixel for displaying an image in the image display region 15, that is, the minimum unit constituting the image. Meanwhile, a point p on an image obtained with the input apparatus corresponds to a point P in the image display region 15 indicated on the upper surface of the image display plate 1 with a dotted line. Consequently, when image information at the point p is inputted, the color and density of liquid D that should be positioned at the point P of the image display region 15 are determined.

Figure 6:
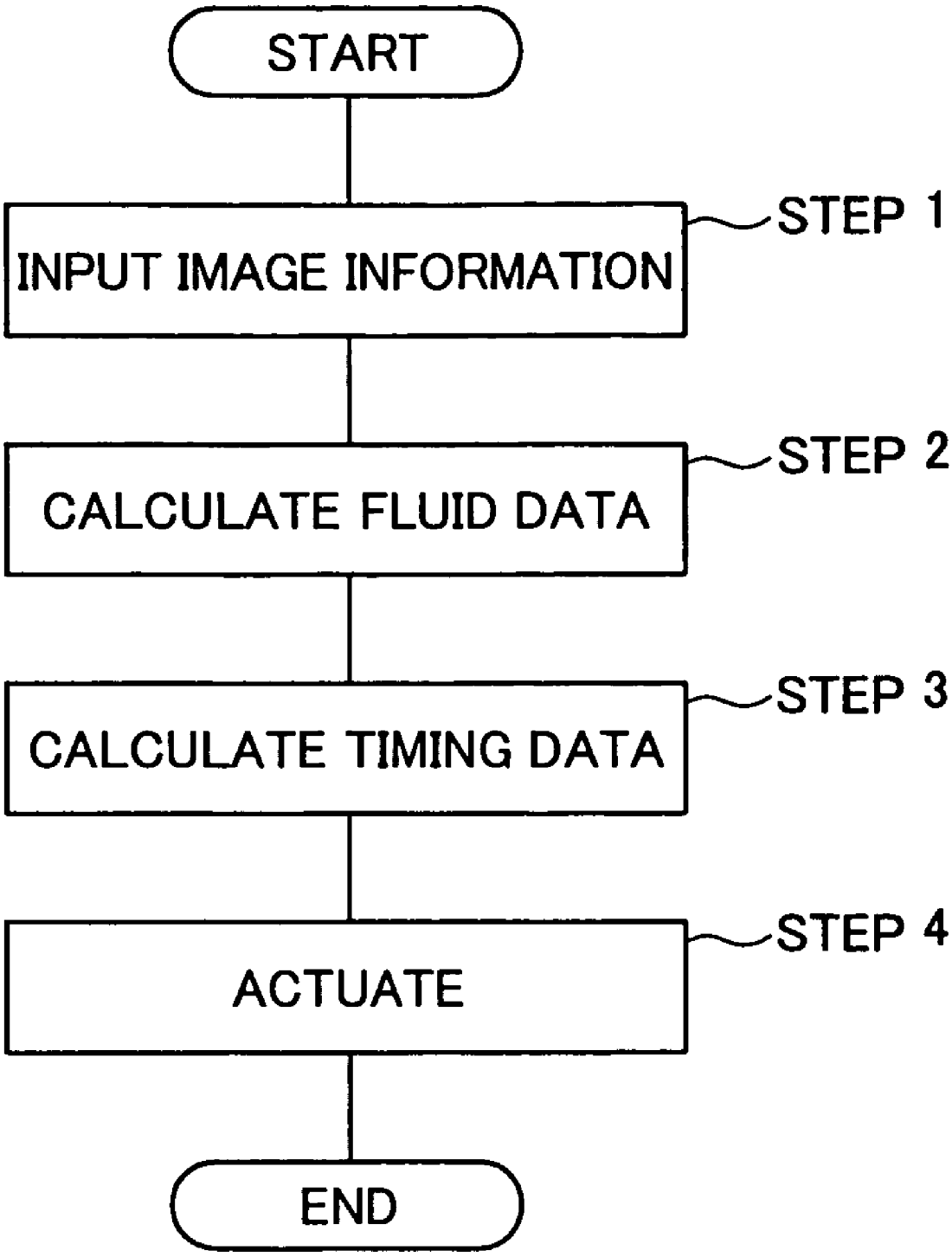
FIG. 6 is a flowchart from image information input to image formation according to the first embodiment of the present invention.

Next, a procedure from input of the image information at the point p to formation of a point image (dot) at the point P on the image display plate 1 will be described. FIG. 6 is a flowchart showing a processing flow from the image information input to the actual image formation.

When image information corresponding to each pixel is inputted from the input apparatus such as a scanner (step 1), the control portion 30 sequentially determines a fluid row composed of liquid D and separation fluid V separating the liquid D as a segment fluid row that is necessary to form a point image (dot) at each required point on the image display plate 1 corresponding to one pixel (point P corresponding to the pixel point p in the case shown in FIG. 5). The segment fluid row is such a row that when this fluid row is moved in the flow path 2, the liquid D is supplied to predetermined positions of the flow path 2 (more specifically, the positions of dote constituting an image that should be displayed in the image display region 15).

In the case shown in FIG. 5, for instance, in order to form the point image (dot) at the point P on the image display plate 1, a segment fluid row is determined in which a certain amount of separation fluid v that fills the flow path 2 from the start portion, that is, the pixel equivalent portion $X_z$ at the lower right corner of the image display region 15 to the pixel equivalent portion ($X_{n+1}$) immediately preceding the point P, a certain amount of liquid D filling the flow path 2 in the pixel equivalent portion $X_n$ corresponding to the point image (dot) formation point P, and a certain amount of separation fluid V filling the flow path 2 from the pixel equivalent portion ($X_{n-1}$) immediately succeeding the point P to the end portion, that is, the pixel equivalent portion $X_1$ are arranged in this order.

More specifically, data necessary to form the segment fluid row, that is, data (hereinafter referred to as the "fluid data") concerning the liquid D and the separation fluid V is calculated. The calculated fluid data shows the required amount (W) of liquid D to form the point image (dot) at the point P, the required amounts (volumes) of Y (yellow) ink, M (magenta) ink, and C (cyan) ink to display a color of the point image (dot) at the point P, the required amount (volume) of carrier liquid S, the required volume of separation fluid V to move the liquid D to the position of the point P (that is, the amount of separation fluid V filling the flow path 2 from the pixel equivalent portion $X_Z$ to the pixel equivalent portion $X_{n+1}$ and the amount of separation fluid V filling the flow path 2 from the pixel equivalent portion $X_{n-1}$ to the pixel equivalent portion $X_1$), and the like (step 2).

Next, based on the fluid data calculated in the manner described above, data (hereinafter referred to as the "timing data") showing actuation timings of the apparatus, such as the actuation timings of the pumps 43*a* to 43*c* and the pumps 96*a* to 46*c* and the opening/closing timings of the valves 35*a* to 35*c*, is calculated (step 3). Then, based on the calculated timing data, the pumps 43*a* to 43*c*, the pumps 46*a* to 46*c*, and the valves 35*a* to 35*c* are actuated (step 4), thereby supplying the required amounts of Y (yellow) ink, M (magenta) ink, and C (cyan) ink, the required amount of carrier liquid S, and the required amount of separation fluid V into the flow path 2.

More specifically, through the actuation of the pumps 43*a* to 43*c* and the pumps 46*a* to 46*c*, the required amounts of Y (yellow) ink, M (magenta) ink, and C (cyan) ink to form the point image (dot) at the point P are supplied to the pipes 36 (36*a*, 36*b*, 36*c*) (the carrier liquid S is also supplied as necessary). Then, the first liquid supplied into the pipe 36*a*, the first liquid supplied into the pipe 36*b*, and the first liquid supplied into the pipe 36*c* are merged at the merge point 21 and mixed with each other, thereby forming liquid D having a predetermined color and a predetermined density. Next, the valves 35 (35*a*, 35*b*, 35*c*) are opened/closed at predetermined timings, thereby supplying the liquid D into the flow path 2. Following this, the valves 35 (35*a*, 35*b*, 35*c*) are opened for a predetermined period of time, thereby supplying a predetermined amount of separation fluid V into the flow path 2.

At the point in time when the supply of the predetermined amount of separation fluid V (more specifically, separation fluid V having a volume corresponding to the volume of the flow path 2 from the merge point 21 at the entrance of the flow path 2 to the point P) is ended, the valves 35 (35*a*, 35*b*, 35*c*) are closed. At the point in time when this separation fluid V supply is ended, the liquid D reaches the position of the point P and the point image (dot) is displayed at the point P with the liquid D.

Figure 7:
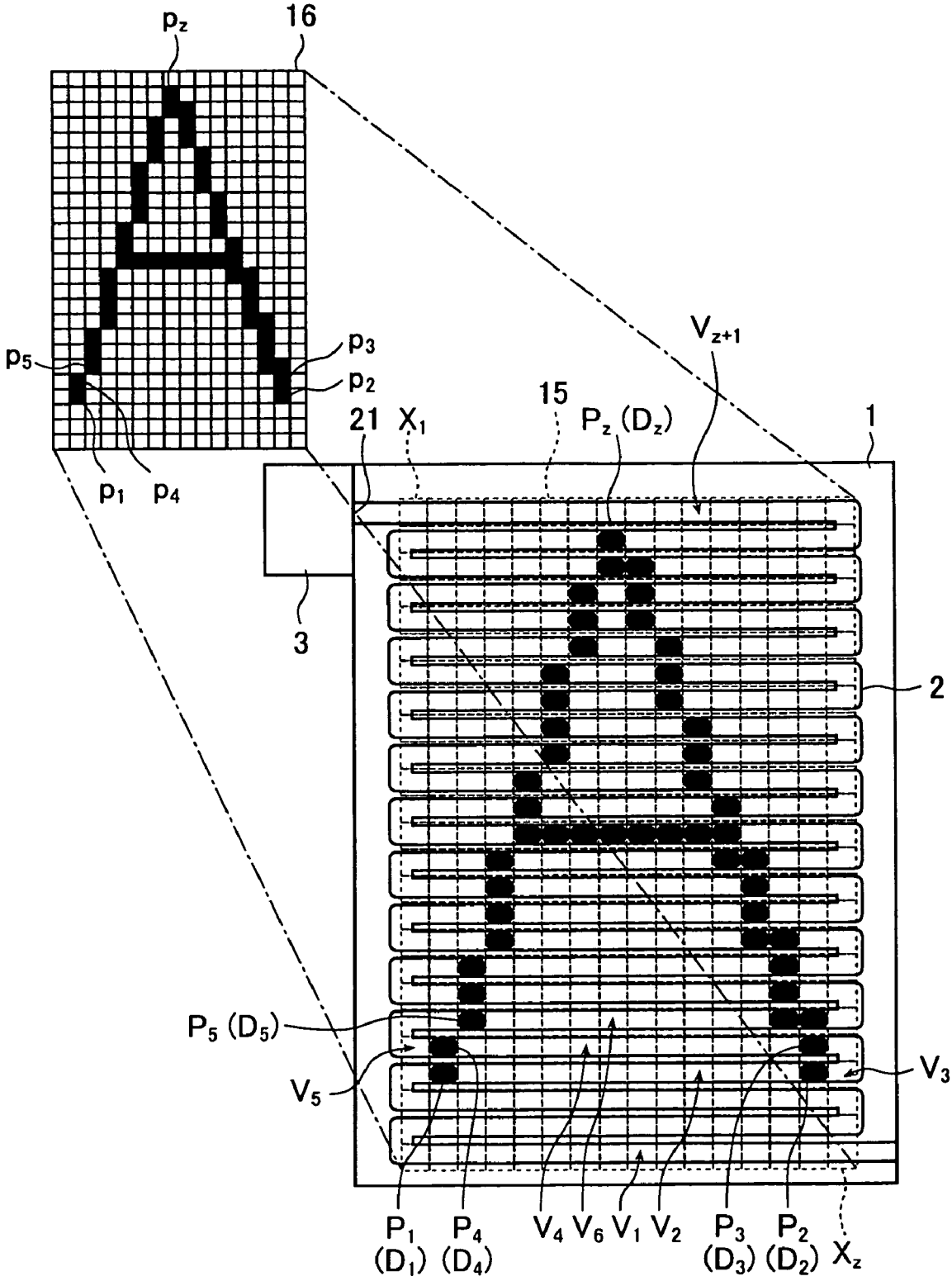
FIG. 7 shows the relation between the input screen and the image display plate according to the first embodiment of the present invention.

Next, a processing flow for displaying an alphabet letter "A" on the image display plate 1 will be described. FIG. 7 shows a relation between an image to be displayed and the image display region 15 in this case. Like in the case described above where the point image is displayed at the point e, when image information for the alphabet letter "A" is inputted from the input apparatus such as a scanner, the control portion 30 determines a segment fluid row required to display the letter "A". This segment fluid row is such a row that is formed by alternately arranging the liquid D ($D_1$, $D_2$, $D_3$, . . . , $D_z$) for forming point images (dots) at multiple points $P_1$, $P_2$, $P_3$, . . . , $P_z$ that are display points of an image of the letter "A" in the image display region 15 and the separation fluid V for separating the liquid D ($D_1$, $D_2$, $D_3$, . . . , $D_z$) from each other and supplying the liquid D ($D_1$, $D_2$, $D_3$, . . . , $D_z$) to predetermined positions in the flow path 2 corresponding to the points $P_1$, $P_2$, $P_3$, . . . , $P_z$.

More specifically, a segment fluid row is determined in which a certain amount of separation fluid $V_1$ filling the flow path 2 from the pixel equivalent portion $X_2$ at the lower right corner of the image display region 15 in FIG. 7 to the point $P_1$, liquid $D_1$ forming a point image (dot) at the point $P_1$, a certain amount of separation fluid $V_2$ filling the flow path 2 between the point $P_1$ and a point $P_2$, liquid $D_2$ forming a point image (dot) at the point $P_2$, a certain amount of separation fluid $V_3$ filling the flow path 2 between the point $P_2$ and a point $P_3$, liquid $D_3$ forming a point image (dot) at the point $P_3$, a certain amount of separation fluid $V_4$ filling the flow path 2 between the point $P_3$ and a point $P_4$, . . . , liquid $D_z$ forming a point image (dot) at a point $P_z$, and a certain amount of separation fluid $V_{z+1}$ filling the flow path 2 between the point $P_z$ and a pixel equivalent portion $X_1$ are arranged in this order.

That is, fluid data is calculated which gives the required volumes of Y (yellow) ink, M (magenta) ink, C (cyan) ink, and carrier liquid S to obtain the liquid D ($D_1$, $D_2$, $D_3$, . . . , $D_z$) forming the point images (dots) at the points $P_1$, $P_2$, $P_3$, . . . , $P_z$, the required volumes of separation fluid $V_1$, $V_2$, $V_3$, . . . , $V_z$ to move the liquid D ($D_1$, $D_2$, $D_3$, . . . , $D_z$) to the positions of the points $P_1$, $P_2$, $P_3$, . . . , $P_z$, and the like. Next, based on the calculated fluid data, timing data is calculated which gives the drive timings of the pumps 46*a* to 46*c* and the pumps 43*a* to 43*c* and the opening/closing timings of the valves 35*a* to 35*c*. Then, based on the calculated timing data, the pumps 46*a* to 46*c* and the pumps 43*a* to 43*c* are driven and the valves 35*a* to 35*c* are opened/closed, thereby supplying the liquid D ($D_1$, $D_2$, $D_3$, . . . , $D_z$) having predetermined volumes and the separation fluid $V_1$, $V_2$, $V_3$, . . . , $V_z$ into the flow path 2.

Figure 8:
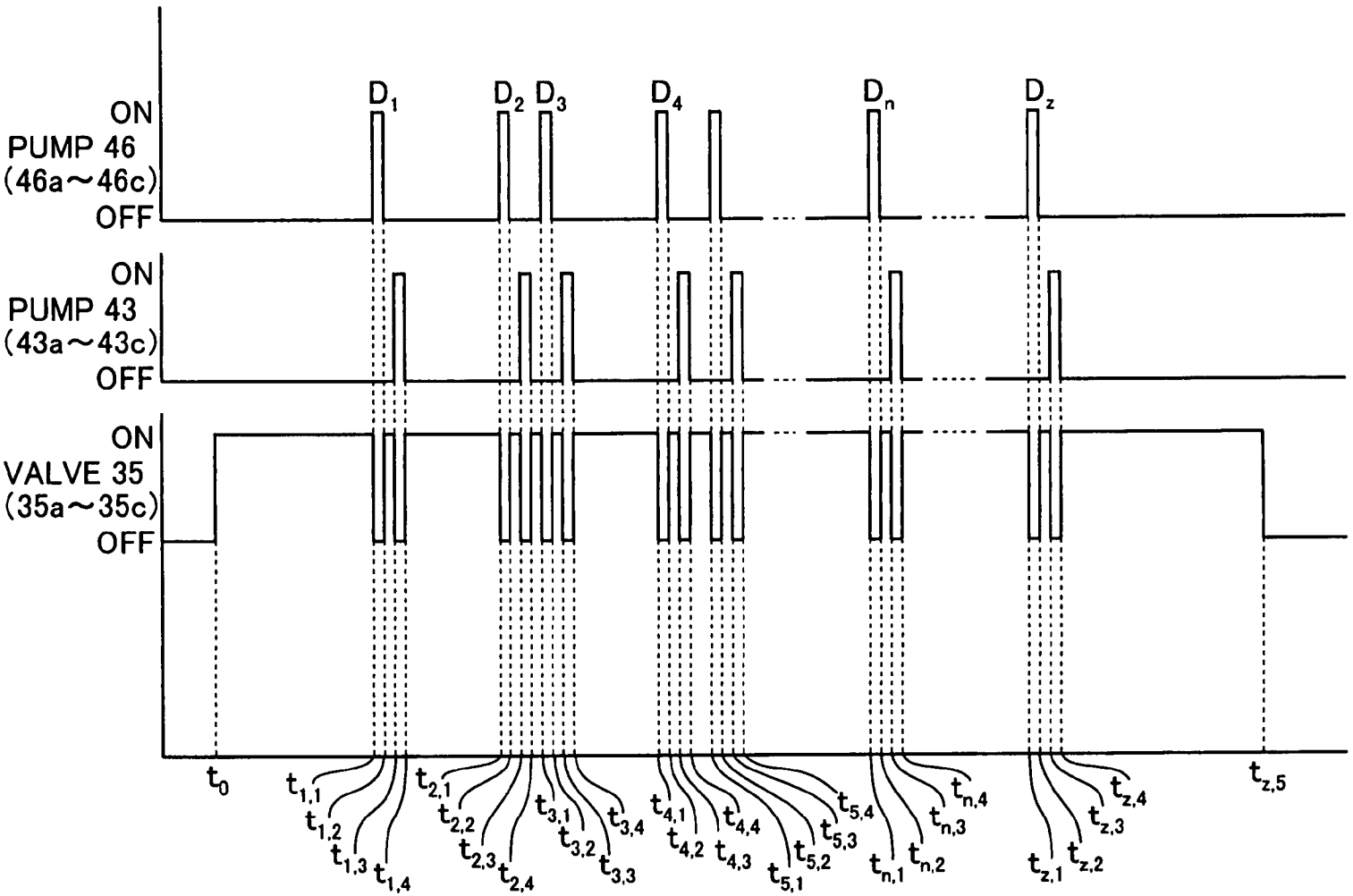
FIG. 8 is a timing chart from a start of image formation to completion of the image formation according to the first embodiment of the present invention.
Figure 9A:
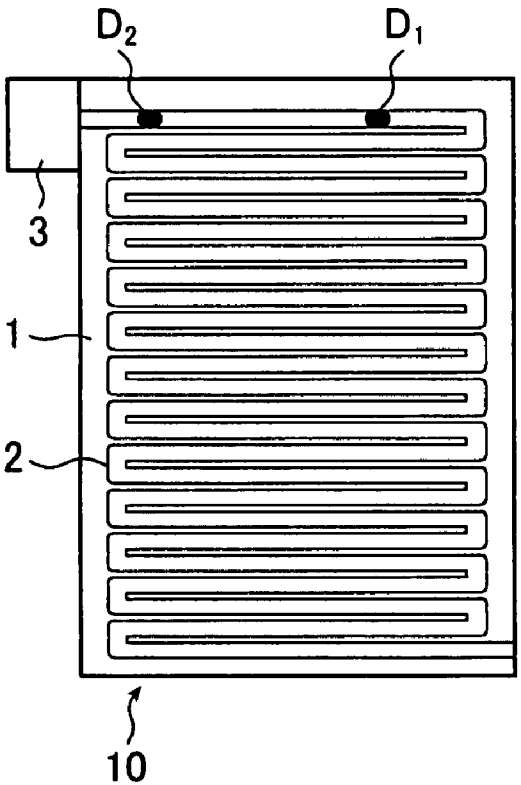
FIGS. 9A to 9C are plan views showing how a display state of the image display apparatus changes by the image formation according to the first embodiment of the present invention.
Figure 9B:
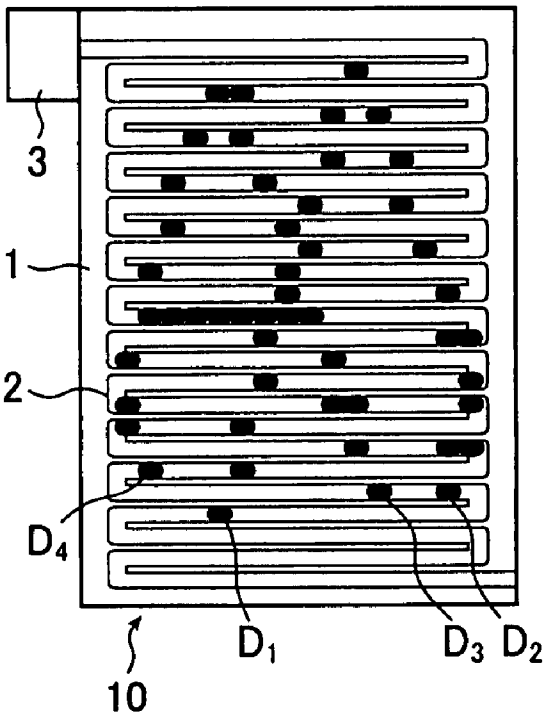
Figure 9C:
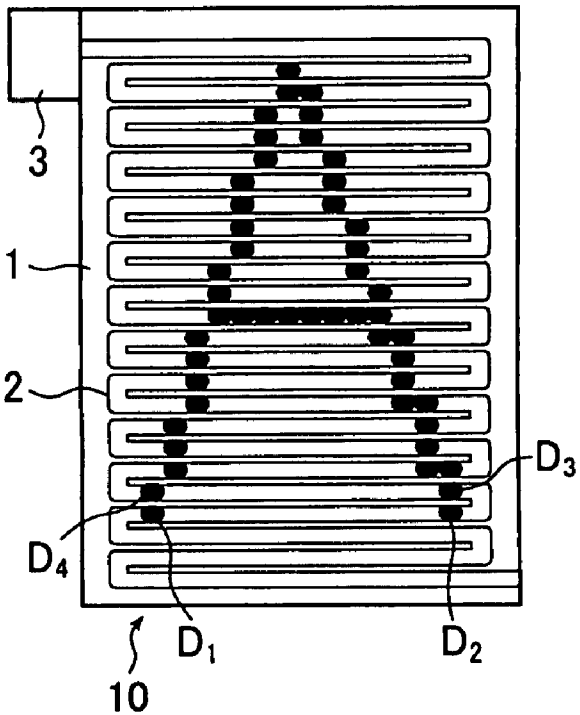

As a result, the liquid D ($D_1$, $D_2$, $D_3$, . . . , $D_z$) having the predetermined volumes is sent to and arranged at the positions of the respective points $P_1$, $P_2$, $P_3$, . . . $P_z$, the point images (dots) are formed at the positions of the points $P_1$, $P_2$, $P_3$, . . . $P_z$, and the image of the letter "A" is displayed in the image display region 15 of the image display plate 1. This processing is illustrated in FIGS. 8 and 9A to 9C. FIG. 8 is a timing chart showing operations from a start to completion of the image formation, while FIGS. 9A to 9C are plan views showing how a display state in the image display region 15 of the image display apparatus 10 changes by the image formation.

Referring to FIG. 8, first, in order to supply the separation fluid $V_1$, the valves 35 (35*a* to 35*c*) are opened in a time slot of $t_0$ to $t_{1,1}$, thereby supplying the separation fluid V into the pipes 36 (36*a* to 36*c*). Next, in order to form the liquid $D_1$ forming the point image (dot) at the position of the point $P_1$, the pumps 46 (46*a* to 46*c*) are actuated in a time slot of $t_{1,1}$ to $t_{1,2}$, thereby supplying carrier liquid S corresponding to the liquid $D_1$ into the pipes 36 (36*a* to 36*c*). Then, in a time slot of $t_{1,2}$ to $t_{2,3}$, the valves 35 (35*a* to 35*c*) are opened, thereby supplying a predetermined amount of separation fluid V into the pipes 36 and sending the carrier liquid S to the positions of the pumps 43 (43*a* to 43*c*). Next, in a time slot of $t_{1,3}$ to $t_{1,4}$, the pumps 43 (43*a* to 43*c*) are actuated, thereby injecting the ink in the vessels 41 (41*a* to 41*c*) into the carrier S moved in the pipes 36 (36*a* to 36*c*).

As a result, the Y (yellow) ink is injected into the carrier liquid S and Y (yellow) first liquid having a predetermined density is formed in the ink connection portion 361*a* or the pipe 36*a* at the time $t_{1,4}$. Similarly, M (magenta) first liquid and C (cyan) first liquid are respectively formed in the ink connection portions 361*b* and 361*c* of the pipes 36*b* and 36*c* at the time $t_{1,4}$. Next, in a time slot of $t_{1,4}$ to $t_{2,1}$, the valves 35*a* to 35*c* are opened, thereby supplying a predetermined amount ($V_2$) of separation fluid V into the pipes 36*a* to 36*c* Consequently, the Y (yellow) first liquid, the M (magenta) first liquid, and the C (cyan) first liquid are merged at the merge point 21 and unified with each other and the Y (yellow) ink, the M (magenta) ink, and the C (cyan) ink are mixed with each other. As a result, the liquid $D_1$ exhibiting a predetermined color is formed and is supplied to the flow path 2. Note that as a matter of course, the opening/closing state and the opening/closing time period of each valve of the pumps 43*a* to 43*c* may be changed in accordance with the color and density that should be displayed.

Following this, similarly, the pumps 46*a* to 46*c* are actuated in a time slot of $t_{2,1}$ to $t_{2,2}$, the valves 35*a* to 35*c* are opened in a time slot of $t_{2,2}$ to $t_{2,3}$, the pumps 43*a* to 43*c* are actuated in a time slot of $t_{2,3}$ to $t_{2,4}$, and the valves 35*a* to 35*c* are opened in a time slot of $t_{2,4}$ to $t_{3,1}$, thereby supplying the liquid $D_2$ and the separation fluid $V_3$ into the flow path 2. Then, the pumps 46*a* to 46*c* are actuated in a time slot $t_{3,1}$ to $t_{3,2}$, the valves 35*a* to 35*c* are opened in a time slot of $t_{3,2}$ to $t_{3,3}$, the pumps 43*a* to 43*c* are actuated in a time slot of $t_{3,3}$ to $t_{3,4}$, and the valves 35*a* to 35*c* are opened in a time slot of $t_{3,4}$ to $t_{4,1}$, thereby supplying the liquid $D_3$ and the separation fluid $V_4$ into the flow path 2.

Following this, similarly, the pumps 43*a* to 43*c*, the pumps 46*a* to 46*c*, and the valves 35*a* to 35*c* are actuated at predetermined timings, thereby supplying the liquid $D_4$, the separation fluid $V_5$, . . . , the liquid $D_n$, the separation fluid $V_{n+1}$, . . . in this order. Then, finally, the liquid $D_z$ and the separation fluid $V_{z+1}$ are supplied in this order. With the passage of time, as shown in FIGS. 9A and 9B, the liquid D ($D_1$, $D_2$, $D_3$, . . . $D_n$) and the separation fluid V ($V_1$, $V_2$, $V_3$, . . . , $V_n$) are supplied into the flow path 2 and the liquid D ($D_1$, $D_2$, $D_3$, . . . , $D_n$) is moved in the downstream direction of the flow path 2 while maintaining constant intervals therebetween. Then, when the supply of the last separation fluid $V_{z+1}$ is ended, the segment fluid row determined in the manner described above is formed in the flow path 2. In this segment fluid row, the separation fluid V ($V_1$, $V_2$, $V_3$, . . . , $V_{z+1}$) and the liquid D ($D_1$, $D_2$, $D_3$, . . . , $D_z$) are arranged so that the liquid D ($D_1$, $D_2$, $D_3$, . . . , $D_z$) having predetermined volumes are supplied to the positions of the point images (dots) for displaying the alphabet letter "A" in the image display region 15, that is, the points $P_1$, $P_2$, $P_3$, . . . , $P_z$. Therefore, when the segment fluid row determined in the manner described above is formed in the flow path 2, as shown in FIG. 9C, the letter "A" appears in the image display region 15 of the surface of the image display plate 1.

As described above, according to this embodiment, an image is formed and held through adjustment of the amounts (volumes) of the liquid D and the separation fluid V supplied into the flow path 2. As a result, it becomes possible to provide an image display apparatus that hold an image without supply of energy from the outside of the apparatus. Also, no energy is required for the image holding, so that it becomes possible to provide an image display apparatus that forms an image having high durability. Further, in the image display plate 1, only the flow path 2 is formed without any minute components such as electrodes and circuits provided. As a result, it becomes possible to provide an image display apparatus that has a simple structure and is capable of achieving miniaturization.

It should be noted here that in this embodiment, an example has been described in which each time a point p on the input screen 16 is inputted from the input apparatus, the control portion 30 identifies its corresponding point P on the image display region 15 and calculates fluid data concerning the volume of liquid D forming an image (dot) at the point P, each ink (Y (yellow), M (magenta), C (cyan)) and carrier liquid S required to construct the liquid D, and separation fluid V required to send the liquid D to the position of the point P, as well as timing data. However, a relation between image information to be inputted (letter "A", for instance) and timing data required to display an image (image of "A", for instance) on the display plate 1 of the image display apparatus 10 may be created as a look-up table in advance and this look-up table may be stored in a storage portion or the like of the control portion 30. In this case, when the image information is inputted from the input apparatus, the timing data and the like required to output the image on the image display apparatus 10 may be obtained from the look-up table.

Second Embodiment

Figure 10:
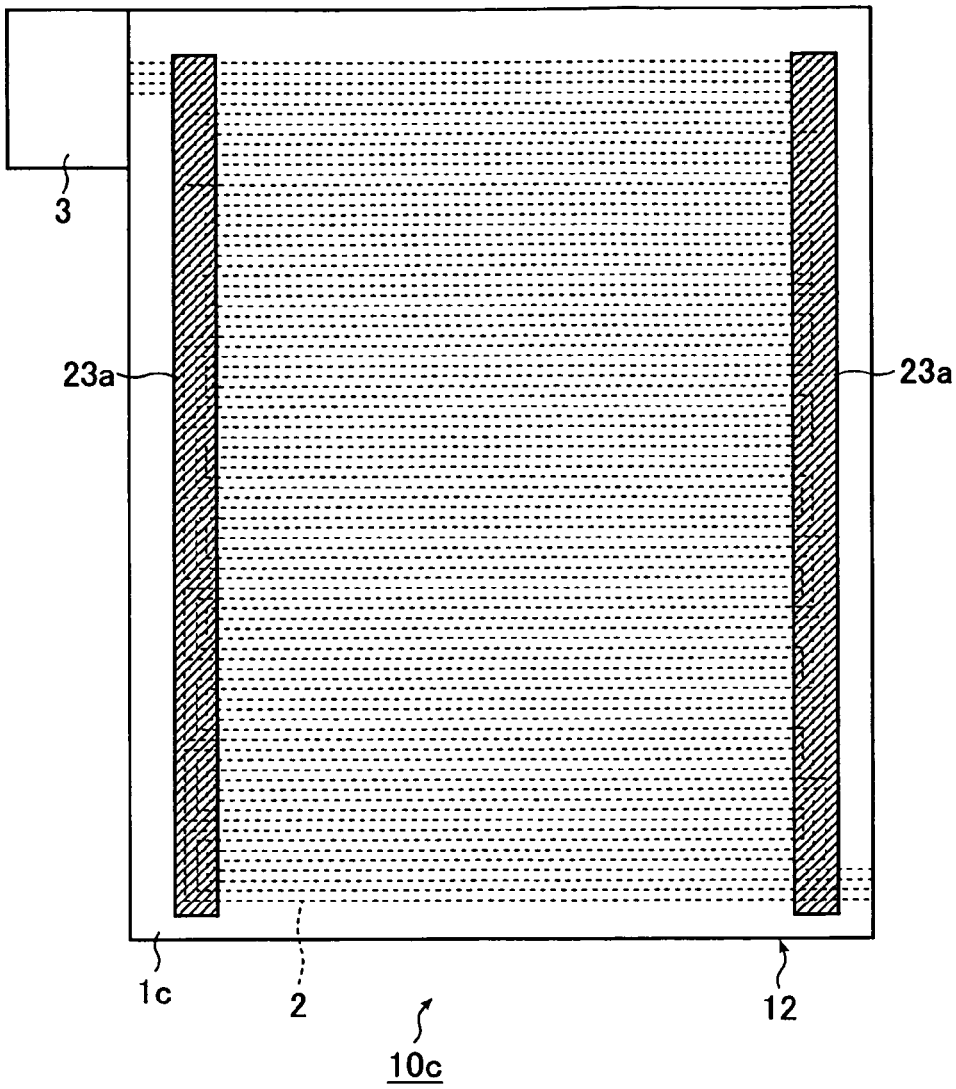
FIG. 10 is a plan view of an image display apparatus according to a second embodiment of the present invention.

Next, a second embodiment of the present invention will be described. In this embodiment, as the position adjustment means for adjusting the positions of liquid D supplied into the flow path, ink-receptive treatment portions are partially provided for the wall surface of the flow path. FIG. 10 is a plan view of an image display apparatus 10*c* according to the second embodiment of the present invention. As shown in FIG. 10, in this embodiment, ink-receptive treatment portions 23*a* serving as the position adjustment means are provided only for the upper portion of the wall surface of the flow path 2 on the periphery of the right and left end portions of an image display plate 1*c* and ink-repellent treatment portions are provided for the remaining portions of the wall surface of the flow path 2. Here, each "ink-receptive treatment portion" refers to a portion given an affinity for the liquid D. For instance, when water-based ink is used as ink constituting the liquid D, a water-receptive treatment portion subjected to water-receptive treatment corresponds to the "ink-receptive treatment portion". On the other hand, when oil-based ink is used, a water-repellent treatment portion subjected to water repellent treatment corresponds to the "ink-receptive treatment portion". In the image display apparatus 10*c* according to this embodiment, the ink-receptive treatment portions 23*a* are provided in the manner described above, so that a self-alignment effect is obtained. In addition, the ink-receptive treatment portions 23*a* are only partially provided for the flow path 2 on the periphery of the right and left end portions of the image display plate 1*c*, so that it becomes possible to reduce the number of steps for forming the ink-receptive treatment portions 23*a* serving as the position adjustment means.

Third Embodiment

Figure 11:
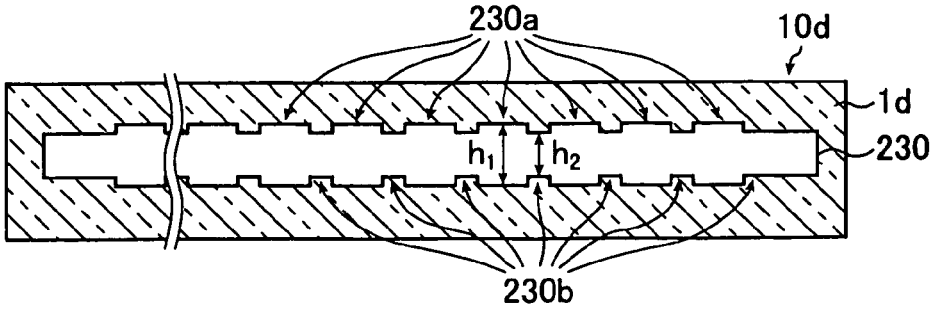
FIG. 11 is a vertical cross-sectional view of an image display apparatus according to a third embodiment of the present invention.

Next, a third embodiment of the present invention will be described. In this embodiment, position adjustment portions that adjust the positions of first liquid in the flow path by changing the width of the flow path in the thickness direction of the image display plate are provided as the position adjustment means. FIG. 11 is a vertical cross-sectional view where an image display plate 1*d* of an image display apparatus 10*d* according to this embodiment is cut along a plane extending along a flow path 230, parallel to the flow path 230, and orthogonal to the surface of the image display plate 1*d*. As shown in FIG. 11, in the image display plate 1*d* according to this embodiment, the width of the flow path 230 in the thickness direction of the image display plate 1*d* (top-bottom direction in FIG. 11) is narrowed in each passage portion 230*b* positioned between two adjacent position adjustment portions 230*a*. That is, in the flow path 230 in FIG. 11, the flow path 230 is formed so that its width in the thickness direction of the image display plate 1*d* is $h_1$ in each position adjustment portion 230*a* corresponding to one pixel, and its width is reduced to $h_2$ in each passage portion 230*b* positioned between (at the boundary between) two adjacent position adjustment portions 230*a*. It is preferable that the ratio between these widths $h_1$ and $h_2$ is in a range of $h_1:h_2=1.05$ to 1.4:1. It is desirable that this ratio between $h_1$ and $h_2$ Is determined with reference to the physical properties of ink constituting liquid D, the physical properties of the flow path surface of the flow path 230, the dimensions (length and the like) of the flow path, the output of each pump for pressurizing the ink, and the like.

In the image display apparatus 10*d* according to this embodiment, the flow path 230 is formed so that its width is increased in each position adjustment portion 230*a* and is decreased in each passage portion 230*b*, so that liquid D is easy to be held in the position adjustment portion 230*a*. Therefore, when a liquid mass D that should be held at the position of a position adjustment portion 230*a* halts at the position of a passage portion 230*b*, the liquid D moves to the position of the position adjustment portion 230*a* where the width of the flow path is set wider and the liquid D is easier to be held. As a result, a "self-alignment effect" is obtained that adjusts the position of the liquid D supplied into the flow path 230. Note that it is preferable that ink-repellent treatment portions are formed on the flow path wall surface of the flow path 230. Also, it is more preferable that an ink-repellent treatment portion is formed on the wall surface in each passage portion 230*b* and an ink-receptive treatment portion is formed on the wall surface in each position adjustment portion 230*a*.

Fourth Embodiment

Figure 12:
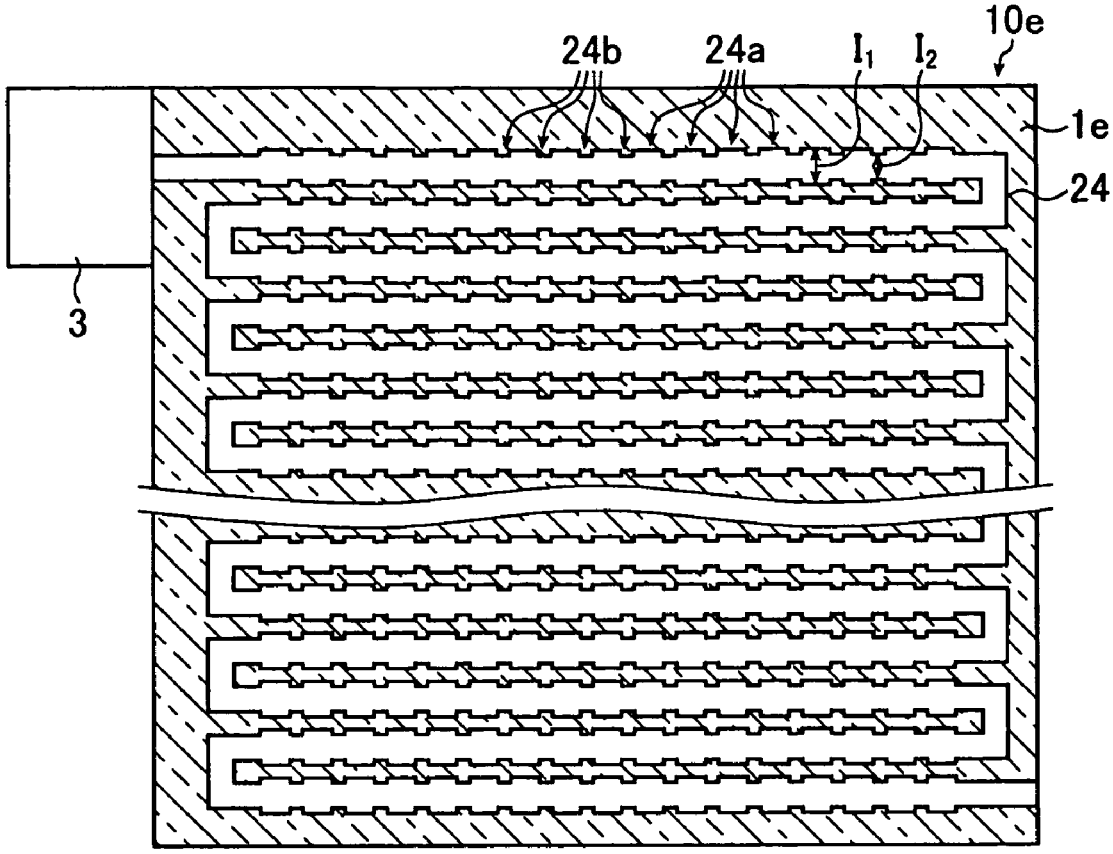
FIG. 12 is a horizontal cross-sectional view of an image display apparatus according to a fourth embodiment of the present invention.

Next, a fourth embodiment of the present invention will be described. FIG. 12 is a horizontal cross-sectional view where an image display plate 1*e* of an image display apparatus 10*e* according to this embodiment is cut along a plane extending parallel to the upper surface of the image display plate 1*e*. As shown in FIG. 12, in the image display plate 1*e* according to this embodiment, a flow path 24 is formed so that its width in the plane direction of the image display plate 1*e* (top-bottom direction in the drawing) is increased in each position adjustment portion 24*a* corresponding to one pixel, and its width is reduced in each passage portion 24*b*. That is, as shown in FIG. 12, the flow path 24 is formed so that its width in the plane direction of the image display plate 1*e* is $I_1$ in each position adjustment portion 24*a* corresponding to one pixel and is reduced to $I_2$ in each passage portion 24*b* positioned between two adjacent position adjustment portions 24*a*. It is preferable that the ratio between these widths $I_1$ and $I_2$ is set in a range of $I_1:I_2=1.05$ to 1.4:1. Also, it is desirable that this ratio between $I_1$ and $I_2$ is determined with reference to the physical properties of ink constituting liquid D, the physical properties of the flow path wall surface of the flow path 24, the dimensions (length and the like) of the flow path, the output of each pump for pressurizing the ink constituting the liquid D, and the like.

In the image display apparatus 10*e* according to this embodiment, the flow path 29 in the image display plate 1*e* is formed so that its width in the plane direction is increased in each position adjustment portion 24*a* and is decreased in each passage portion 24*b*, so that liquid D becomes easy to be held by the position adjustment portion 24*a*. Therefore, when a liquid mass D that should be held at the position of a position adjustment portion 24*a* halts at the position of a passage portion 24*b*, the liquid D moves to the position of the position adjustment portion 24*a* where the width of the flow path is set wider and therefore the liquid D is easier to be held. In this manner, a "self-alignment effect" is obtained that adjusts the position of the liquid D supplied into the flow path 24. Note that it is preferable that ink-repellent treatment portions are formed on the flow path wall surface of the flow path 24. Also, it is more preferable that an ink-repellent treatment portion is formed on the wall surface in each passage portion 24*b* and an ink-receptive treatment portion is formed on the wall surface in each position adjustment portion 24*a*.

Fifth Embodiment

Figure 13:
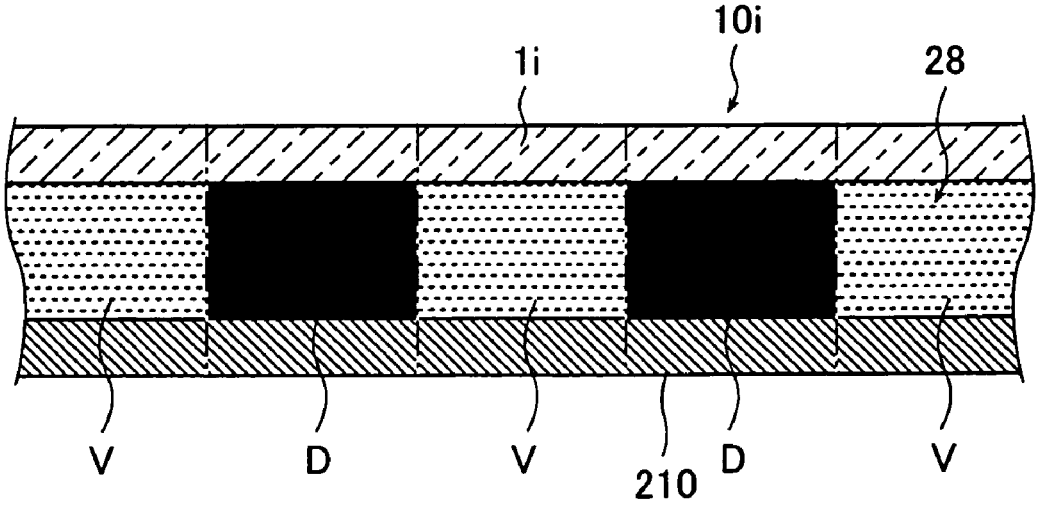
FIG. 13 is a vertical cross-sectional view of an image display apparatus according to a fifth embodiment of the present invention.

Next, a fifth embodiment of the present invention will be described. An image display apparatus 10*i* according to this embodiment has the same structure as the image display apparatus 10 according to the first embodiment except that a reflection plate 210 for reflecting light is provided below a flow path 28 of an image display plate 1*i*. FIG. 13 is a vertical cross-sectional view where an image display plate 1*i* of the image display apparatus 10*i* according to this embodiment is cut along a lengthwise direction of the flow path 28. As shown in FIG. 13, in the image display apparatus 10*i* according to this embodiment, the reflection plate 210 is disposed below the flow path 28 of the image display plate 1*i*. The reflection plate 210 is not specifically limited so long as it has the property of reflecting visible light. For instance, it is possible to use a metallic plate, a resin plate given plating, or the like as the reflection plate 210. Also, the reflection plate 210 may be affixed to the lower surface of the image display plate 1*i* or may be formed by directly performing plating processing on the lower surface of the image display plate 1*i*.

In the image display apparatus 10*i* according to this embodiment, the reflection plate 210 is provided below the flow path 28 of the image display plate 1*i*, so that when liquid having coloring matters and transparency is used as liquid D, light incident from the upper surface of the image display plate 1 and reflected by the surface of the reflection plate 210 appears on the surface of the image display plate 1. Therefore, it becomes possible to display a clear image without using an illumination light source such as a backlight.

Sixth Embodiment

Figure 14:
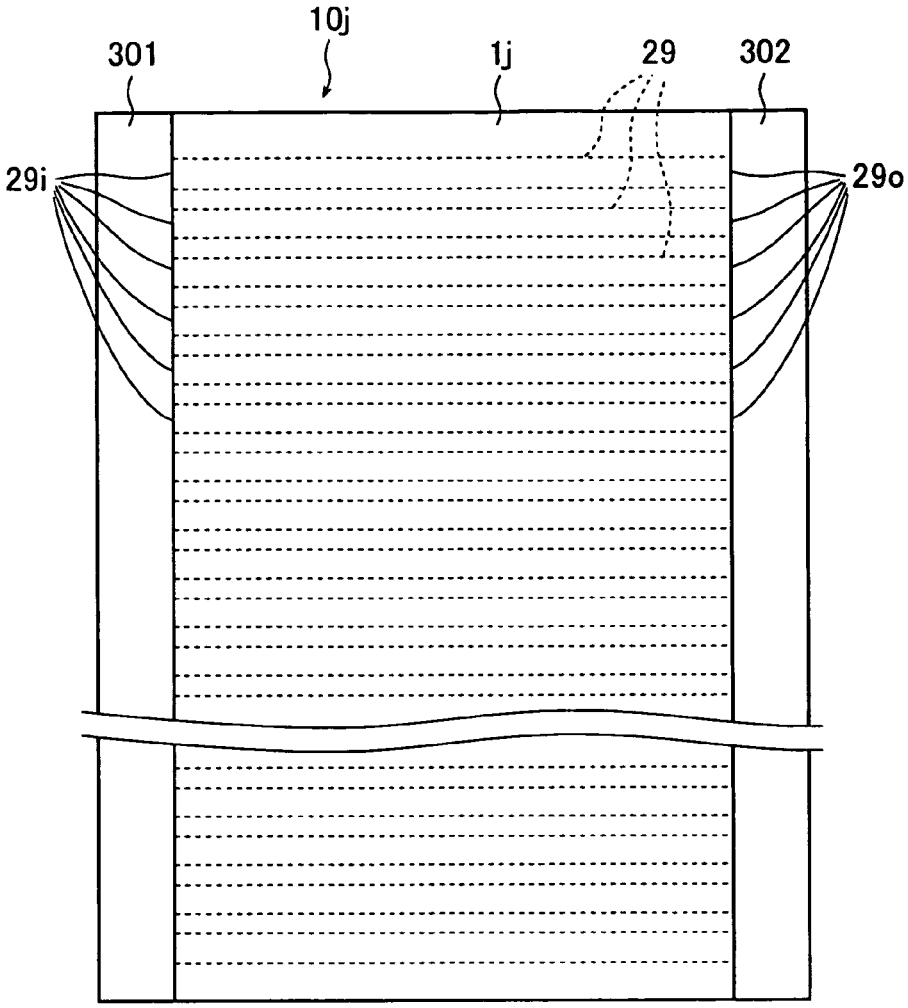
FIG. 14 is a plan view of an image display apparatus according to a sixth embodiment of the present invention.

Next, a sixth embodiment of the present invention will be described. An image display apparatus 10*j* according to this embodiment includes multiple flow paths 29, 29, . . . arranged parallel to each other in an image display plate 1*j*. FIG. 14 is a plan view of the image display apparatus 10*j* according to this embodiment. As shown in FIG. 14, in the image display apparatus 10*j* according to this embodiment, the multiple flow paths 29, 29, . . . are formed in the image display plate 1*j* so as to extend parallel to each other in a direction of one side of the image display plate 1*j*. Each of the multiple flow paths 29 has an entrance 29*i* and an exit 29*o* in the both side surfaces of the image display plate 1*j*.

In this embodiment, as shown in FIG. 14, the entrance 29*i* of the multiple flow paths 29, 29, . . . are disposed in the left-side surface of the image display plate 1*j* in the drawing and the exits 29*o* thereof are disposed in the right-side surface of the image display plate 1*j*. Also, a segment fluid row formation unit 301 is arranged adjacent to the left-side surface of the image display plate 1*j* and a fluid recovery unit 302 is arranged adjacent to the right-side surface of the image display plate 1*j*. Further, separation fluid and first liquid are supplied from the segment fluid row formation unit 301 into the respective flow paths 29, 29, . . . independently of each other.

In the image display apparatus 10*j* according to this embodiment, the multiple flow paths 29, 29, . . . are short, so that it becomes possible to shorten a period of time from the start to completion of the image formation. Also, the liquid D and the separation fluid V are supplied to the respective flow paths 29, 29, . . . independently of each other, so that it becomes possible to minimize displacements of an image formed by the liquid D in the fluid moving direction.

Seventh Embodiment

Figure 15:
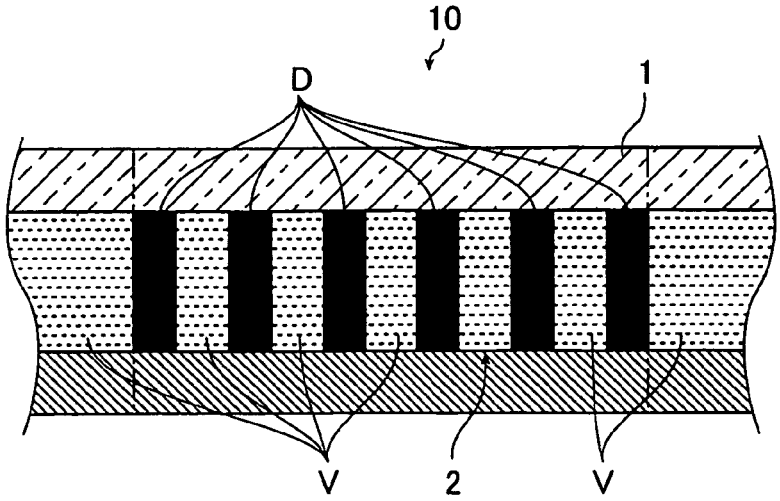
FIG. 15 is a vertical cross-sectional view of an image display apparatus according to a seventh embodiment of the present invention.

Next, a seventh embodiment of the present invention will be described. Note that an image display apparatus 10 according to this embodiment has the same construction as in the first embodiment and therefore the construction of the image display apparatus will not be described in this embodiment. In the image display apparatus 10 according to this embodiment, image gradation is expressed by controlling a segment fluid row formation unit. FIG. 15 is an enlarged vertical cross-sectional view where an image display plate 1 according to this embodiment is cut along the lengthwise direction of a flow path 2. In FIG. 15, the two-dot chain lines indicate a portion corresponding to one pixel. As shown in FIG. 15, in the image display apparatus 10 according to this embodiment, pumps 43*a* to 43*c* and 46*a* to 46*c* for supplying liquid D and valves 35*a* to 35*c* for controlling supply of separation fluid V in the segment fluid row formation unit 3 are alternately turned ON/OFF at extremely short time intervals, thereby supplying the separation fluid V and the liquid D so as to draw a striped pattern in one pixel equivalent portion (see FIG. 4). By supplying the separation fluid V and the liquid D in this manner, it becomes possible to adjust the proportion of the liquid D in one pixel equivalent portion, which makes it possible to express image gradation.

What is claimed is:

1. An image display apparatus that displays an image using liquid, comprising:

an image display plate having an image display region;

a flow path provided in accordance with said image display region and regulating a moving direction of the fluid; and a segment fluid row formation means for generating a segment fluid row, in which plural liquid masses each of which includes first liquid having at least one predetermined coloring matter and are separated from each other are arranged in a row shape, by sequentially and intermittently supplying predetermined amounts of the first liquid to said flow path in accordance with image information of a desired image to be displayed, and causing the generated segment fluid row to move in said flow path, wherein the desired image is displayed in said image display region by the first liquid of the segment fluid row moved to a predetermined position of said flow path.

2. The image display apparatus according to claim 1, wherein said plural liquid masses of the segment fluid row are separated from each other by gas or liquid.

3. The image display apparatus according to claim 1, wherein said segment fluid row formation means generates the segment fluid row by arranging plural liquid masses made of second liquid having transparency in a row shape through division of the second liquid in advance and injecting the first liquid into said plural liquid masses of the second liquid in accordance with the image information.

4. The image display apparatus according to claim 1, wherein said segment fluid row formation means generates the segment fluid row by arranging said plural liquid masses made or the first liquid in a row manner through division of the first liquid in advance and injecting second liquid into said plural liquid masses of the first liquid in accordance with the image information.

5. The image display apparatus according to claim 1, wherein the first liquid included in each liquid mass is one of liquid colored using at least one of three coloring matters for R (red), G (green), and B (blue) and liquid colored using at least one of four coloring matters for C (cyan), M (magenta), Y (yellow), and K (black).

6. The image display apparatus according to claim 1, wherein said flow path includes a position adjustment means for, when the movement of the segment fluid row by said segment fluid row formation means is stopped, adjusting a position of each liquid mass of the segment fluid row.

7. The image display apparatus according to claim 6, wherein said position adjustment means is one of water-repellent treatment portions and water-receptive treatment portions formed for a wall surface of said flow path and holding each liquid mass of the segment fluid row.

8. The image display apparatus according to claim 6, wherein said position adjustment means is depression portions formed for a wall surface of said flow path and holding each liquid mass of the segment fluid row.

9. The image display apparatus according to claim 1, wherein said flow path has one flow path entrance and one flow path exit and one segment fluid row moving path is formed between said flow path entrance and said flow path exit.

10. The image display apparatus according to claim 1, wherein said flow path has at least two flow path entrances and at least two flow path exits, with said flow path entrances and said flow path exits being in a one-to-one correspondence, and at least two segment fluid row moving paths are formed between said flow path entrances and said flow path exits.

11. The image display apparatus according to claim 10, wherein said segment fluid row moving paths extend parallel to each other.

12. An image display method for displaying an image using liquid, comprising:

generating a segment fluid row, in which plural liquid masses each of which includes first liquid having at least one predetermined coloring matter and are separated from each other are arranged in a row shape, by sequentially and intermittently supplying predetermined amounts of the first liquid in accordance with image information of a desired image to be displayed to a flow path provided in accordance with an image display region for image displaying; and displaying the desired image in said image display region with the first liquid by causing the generated segment fluid row to move to a predetermined position of said flow path.

* * * * *

UNITED STATES PATENT AND TRADEMARK OFFICE

CERTIFICATE OF CORRECTION

PATENT NO. : 7,304,620 B2
APPLICATION NO. : 10/934093
DATED : December 4, 2007
INVENTOR(S) : Yamamoto et al.

It is certified that error appears in the above-identified patent and that said Letters Patent is hereby corrected as shown below:

In claim 4, column 17, line 37, please replace “or” with --of--.

Signed and Sealed this

Sixth Day of May, 2008

JON W. DUDAS
*Director of the United States Patent and Trademark Office*